United States Patent [19]

Rodewald

[11] 4,273,325

[45] Jun. 16, 1981

[54] SHINGLED SHEET ALIGNMENT

[75] Inventor: Dennis W. Rodewald, Phillips, Wis.

[73] Assignee: Marquip, Inc., Phillips, Wis.

[21] Appl. No.: 18,603

[22] Filed: Mar. 8, 1979

[51] Int. Cl.[3] ..... B65H 31/26

[52] U.S. Cl. ..... 271/220; 271/240

[58] Field of Search ..... 271/182, 216, 220, 223, 271/240, 241, 248, 224

[56] References Cited

U.S. PATENT DOCUMENTS

| | | | |
|---|---|---|---|
| 1,512,679 | 10/1924 | Dudley | 271/220 UX |
| 2,995,366 | 8/1961 | Maidment | 271/220 X |
| 3,046,010 | 7/1962 | Schneider | 271/223 X |
| 3,198,518 | 8/1965 | Carlson | 271/223 |
| 3,700,232 | 10/1972 | Weigert | 271/216 X |
| 4,151,942 | 5/1979 | Hope | 226/199 |

FOREIGN PATENT DOCUMENTS

| | | | |
|---|---|---|---|
| 871279 | 4/1942 | France | 271/182 |

OTHER PUBLICATIONS

IBM Technical Disclosure Bulletin, vol. 20, No. 6, pp. 2122–2124, Nov. 1977, "Copier Exit Tray", W. M. Hammond et al.

*Primary Examiner*—Richard A. Schacher

*Attorney, Agent, or Firm*—Andrus, Sceales, Starke & Sawall

[57] ABSTRACT

An anti-skew device is positioned between a stacker input nip and stacker in a shingled sheet conveying apparatus. A plurality of fingers are mounted along a transverse mounting element disposed between the nip and the stacker. The fingers are designed to normally hang downwardly, but some of them are raised upwardly as they are engaged by a sheet passing therebeneath, and rest on top of the moving shingled sheets. The transverse mounting element is longer than the width of the sheets and some of the fingers disposed outwardly of the sheets continue to hang down and provide an alignment guide to hold the longitudinal sheet edges against shifting or skewing. The downwardly hanging outer fingers are disposed adjacent the side edges of the formed stack to hold the upper sheets therein in alignment.

4 Claims, 3 Drawing Figures

SHINGLED SHEET ALIGNMENT

BACKGROUND AND SUMMARY OF THE INVENTION

This invention relates to the handling of a plurality of sheets of conveyed sheet material, such as corrugated paperboard and the like. The concept of the invention provides an improvement over devices such as that disclosed in copending U.S. patent application Ser. No. 906,059 filed May 15, 1978, entitled "Shingling And Stacking Of Conveyed Sheet Material", by Carl R. Marschke and assigned to a common assignee.

In such devices, a plurality of sheets are passed through a shingling station and then conveyed to a sheet stacker. A nip is disposed at the entrance to the stacker and through which the shingled sheets pass. The nip comprises a pair of nip rollers with the lower roller positioned so that the trailing end portion of each sheet drops off the lower roller onto the stack being formed.

It has been discovered that, at least in some instances, as a sheet drops off the lower nip roller it tends to shift or skew sideways, sometimes by a substantial amount. This is undesirable in that the stack formed as the sheets engage the backstop will not be uniform in horizontal dimension.

It is an aim of the present invention to handle the shingled sheets in such a manner that undesirable shifting or skewing of the sheets is substantially reduced or prevented.

In accordance with the invention, an anti-skew device is positioned between the stacker input nip and the stacker itself. In the embodiment disclosed, the device comprises a plurality of fingers mounted along a transverse mounting element disposed between the nip and the stacker. The fingers are designed to normally hang downwardly, but some of them are raised upwardly as they are engaged by a sheet passing therebeneath, and rest on top of the moving shingled sheets. The transverse mounting element is longer than the width of the sheets and some of the fingers disposed outwardly of the sheets continue to hang down and provide an alignment guide to hold the longitudinal sheet edges against shifting or skewing. The downwardly hanging outer fingers are disposed adjacent the side edges of the formed stack to hold the upper sheets therein in alignment.

BRIEF DESCRIPTION OF THE DRAWINGS

The accompanying drawings illustrate the best mode presently contemplated by the inventor for carrying out the invention.

In the drawings.

DESCRIPTION OF THE PREFERRED EMBODIMENT

Figure 1:
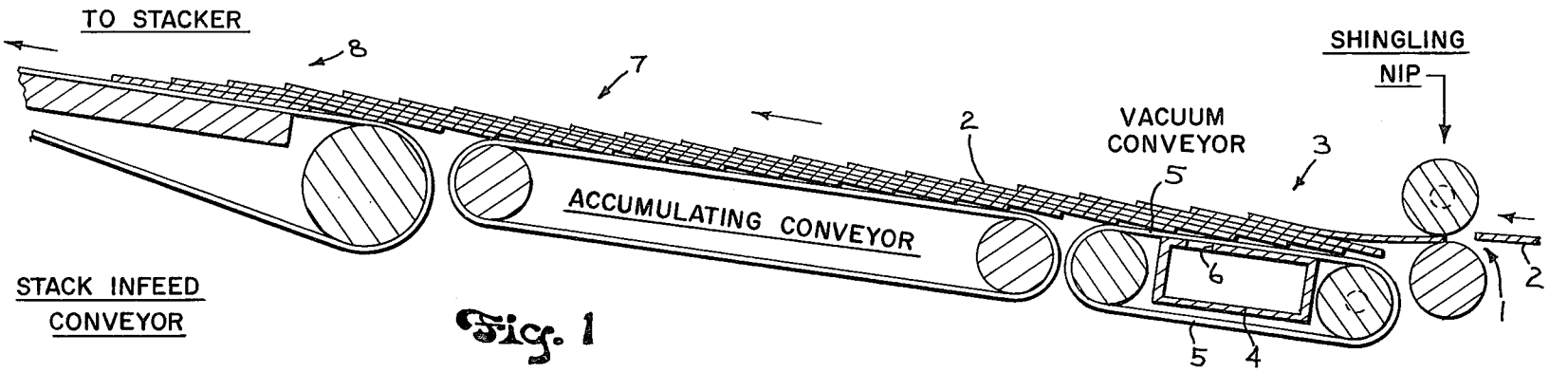
FIG. 1 is a schematic side elevational view of a shingler and conveyor for sheet material.

The concept of the invention may be used with a device of the type disclosed in the aforementioned copending U.S. patent application Ser. No. 906,059. As shown in FIG. 1, a pair of rollers form a shingling nip 1 which feeds a plurality of sheets 2 to a vacuum conveyor section 3 having a vacuum box 4 disposed between upper and lower belt flights 5. Box 4 has an opening 6 in its upper wall to apply a vacuum or negative pressure to sheets 2 which descend thereupon. Belt flights 5 travel at a relatively slower speed than an upstream conveyor, not shown, to thereby cause the sheets to be shingled.

Subsequently, sheets 2 are conveyed along an accumulating conveyor 7 and a motor driven stack infeed conveyor 8 to a sheet stacker 9.

Figure 2:
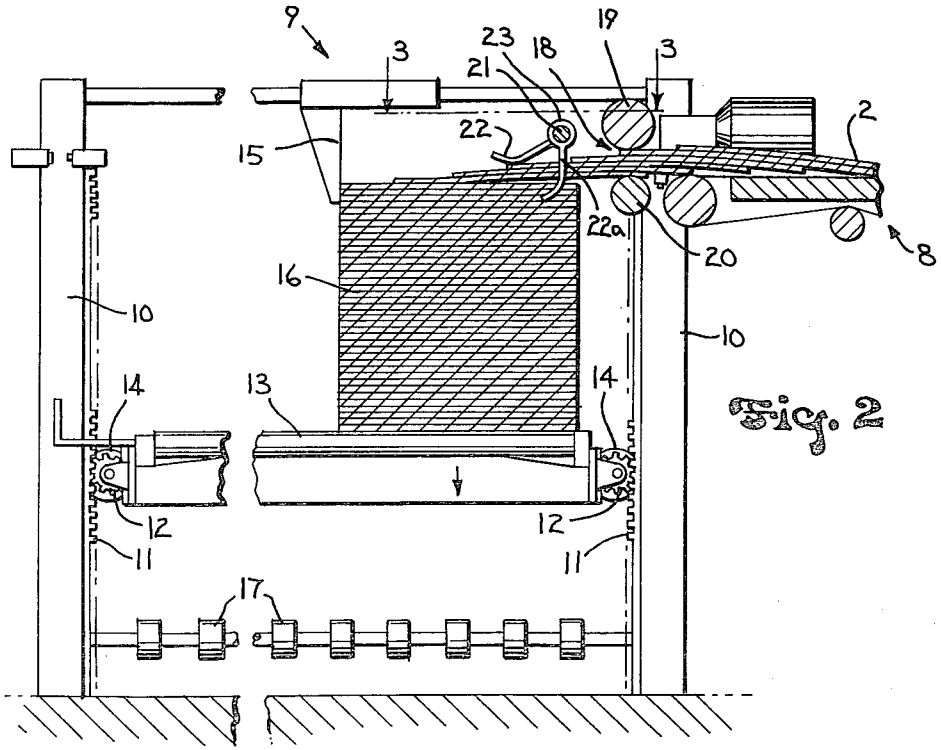
FIG. 2 is a schematic side elevational view of the donwstream end of the conveyor of FIG. 1, showing the stacker and the skew-reduction device.

As shown in FIG. 2, stacker 9 includes a frame 10 having a pair of vertical frame members having racks 11 thereon. Racks 11 in turn mesh with pinions 12 mounted on a roller-type stacker platform 13 and which are adapted to be driven by motors 14 to move the platform vertically within the frame. As the sheets 2 enter stacker 9 from the upstream conveyor 8, they engage an adjustable backstop 15 which aligns the sheets into an end justified vertical stack 16. As sheets 2 build up on the stack, motors 14 operate to gradually lower platform 13 so that the top of the stack remains generally constant in the same horizontal plane.

Stacker 9 includes bottom discharge rollers 17 onto which the stack may be rolled for discharge out of the device.

Referring to FIG. 2, an infeed nip 18 is disposed between the downstream end of conveyor 8 and stacker 9. Nip 18 comprises a pair of transverse rollers which are vertically spaced, with upper roller 19 being slightly larger than lower roller 20. As the shingled sheets 2 come off of conveyor 8, they pass through nip 18 and drop one-by-one in succession onto stack 16.

As previously pointed out, as sheets 2 are released from the nip and dropped onto the stack, they have sometimes tended to shift or skew sideways so that the stack edges were not properly justified. This problem has now been substantially alleviated.

In accordance with the invention, an anti-skew device is disposed downstream of nip 18 and at the upper upstream portion of stack 16.

Figure 3:
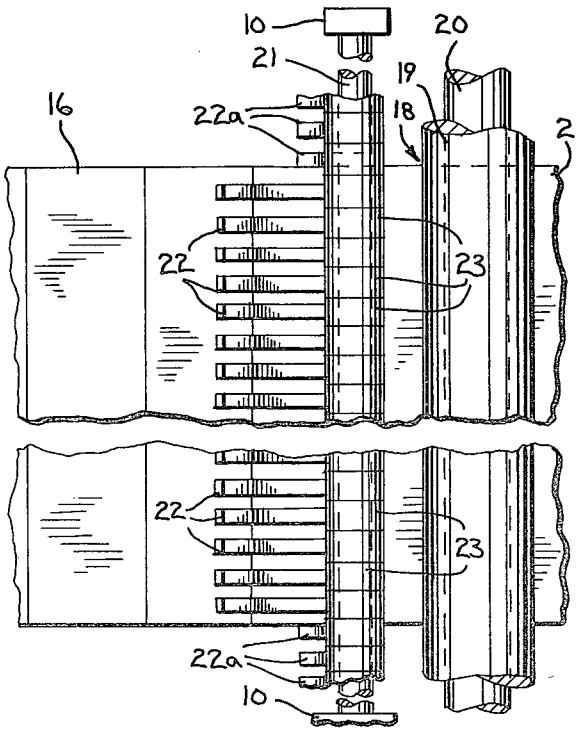
FIG. 3 is a top plan view taken on line 3—3 of FIG. 2.

Referring to FIGS. 2 and 3, the anti-skid device includes an elongated transverse mounting element, in this instance a rod 21, which extends between portions of frame 10 above the path of traveling sheets and also above the input end portion of stack 16. Rod 21 carries means for preventing any substantial sheet skew, and for this purpose a plurality of fingers 22 are mounted to the rod and are arrayed axially therealong. In the present embodiment, fingers 22 are connected at their bases to ring-like supports 23 which are individually and freely mounted on rod 21 so that the fingers are freely swingable about the rod axis.

Rod 21 extends outwardly beyond the longitudinal sheet edges and provides outer end portions on which fingers are also disposed. The fingers are held against axial sliding movement, as by being confined between frame portions 10.

Fingers 22 normally hang downwardly by gravity from rod 21. However, as stacked sheets 2 are fed through nip 18, the sheets engage the central portion of fingers 22 and cause them to swing forwardly and upwardly about rod 21 so that they rest on the traveling sheets. The weight of the raised fingers provides a downward biasing force to the sheets as they are stacked.

Those fingers 22*a* which are not in the sheet path but are disposed beyond the longitudinal edges of sheets 2 remain unaffected by the sheet pass-through and continue to hang downwardly. Fingers 22*a* that are closest to the outer sheet edges function as stops or alignment guides which prevent any substantial sideways shifting or skewing of the traveling sheets.

Because in the present embodiment the fingers are arrayed along the entire length of rod 21, sheets 2 of many different widths may be automatically accommodated, with a resultant change in those particular fingers which are raised and those which act as guides.

In the event sheets 2 stop passing through nip 18, the central fingers 22 will still remain in their upper position, resting on stack 16. In all events, the downwardly hanging side fingers 22*a* will remain at the side of the formed stack and keep the upper sheets therein properly aligned.

Various modes of carrying out the invention are contemplated as being within the scope of the following claims particularly pointing out and distinctly claiming the subject matter which is regarded as the invention.

I claim:

1. In a sheet handling device:

(a) a conveyor for conveying a plurality of sheets in succession, (b) a nip disposed at the discharge end of the conveyor for passing sheets therethrough, (c) a sheet stacker disposed downstream of said nip for receiving and stacking said sheets, (d) and stop means disposed between said nip and said stacker for guiding the longitudinal sheet edges in a manner to prevent transverse shifting of said edges as the sheets pass from said nip to said stacker, said stop means comprising:

(1) an elongated mounting element disposed above the path of the traveling sheets and extending transversely thereof and outwardly beyond the said longitudinal sheet edges, (2) and a plurality of fingers normally hanging downwardly by gravity and arrayed along said mounting element, (3) a first portion of said fingers being disposed in the path of said sheets and engageable thereby so that said first portion of fingers are swung forwardly and upwardly about a transverse axis and rest on the sheets, (4) and a second portion of said fingers remaining out of the path of the traveling sheets and hanging downwardly to guide the said longitudinal sheet edges.

2. The sheet handling device of claim 1 wherein said stop means also comprises means to hold the upper sheets in the formed stack in alignment.

3. The sheet handling device of claim 1 wherein:

(a) said mounting element comprises a rod, (b) and said fingers are individually mounted to said rod for free swinging movement thereon.

4. The sheet handling device of claim 1 wherein said second portion of fingers hang donwardly along the side edges of the formed stack to hold the upper sheets therein in alignment.

* * * * *

US004273325B1

REEXAMINATION CERTIFICATE (2080th)

United States Patent [19]

Rodewald

[11] B1 4,273,325

[45] Certificate Issued Sep. 7, 1993

[54] SHINGLED SHEET ALIGNMENT

[75] Inventor: Dennis W. Rodewald, Phillips, Wis.

[73] Assignee: Marquip, Inc., Phillips, Wis.

Reexamination Request:
No. 90/002,941, Jan. 26, 1993

Reexamination Certificate for:

| | |
|---|---|
| Patent No.: | **4,273,325** |
| Issued: | **Jun. 16, 1981** |
| Appl. No.: | **18,603** |
| Filed: | **Mar. 8, 1979** |

[51] Int. Cl.[5] ..... B65H 31/26
[52] U.S. Cl. ..... 271/220; 271/240
[58] Field of Search ..... 271/182, 216, 220, 223, 271/240, 241, 248, 224

[56] References Cited

U.S. PATENT DOCUMENTS

| | | | |
|---|---|---|---|
| 1,275,585 | 8/1918 | Morgan et al. . | |
| 2,916,286 | 12/1959 | Keating | 271/89 |
| 3,022,998 | 2/1962 | Patalon | 271/49 |
| 3,429,416 | 2/1969 | Provost et al. | 198/20 |
| 3,757,154 | 9/1973 | Binkowski | 317/2 |
| 3,791,269 | 2/1974 | Sawada | 93/93 |
| 3,938,674 | 2/1976 | Kroeze et al. | 214/6 |
| 3,985,055 | 10/1976 | Cornell | 83/367 |
| 4,133,523 | 1/1979 | Berthelot | 271/182 |
| 4,142,454 | 3/1979 | Staufner | 93/93 |
| 4,222,313 | 9/1980 | Staufner | 93/93 |
| 4,273,325 | 6/1981 | Rodewald | 271/220 |

OTHER PUBLICATIONS

W. M. Hammond and G. E. Siemer, Copier Exit Tray, IBM Technical Disclosure Bulletin, vol. 20, No. 6, Nov. 1977, pp. 2122–2124.

*Primary Examiner*—Richard A. Schacher

[57] ABSTRACT

An anti-skew device is positioned between a stacker input nip and stacker in a shingled sheet conveying apparatus. A plurality of fingers are mounted along a transverse mounting element disposed between the nip and the stacker. The fingers are designed to normally hang downwardly, but some of them are raised upwardly as they are engaged by a sheet passing therebeneath, and rest on top of the moving shingled sheets. The transverse mounting element is longer than the width of the sheets and some of the fingers disposed outwardly of the sheets continue to hang down and provide an alignment guide to hold the longitudinal sheet edges against shifting or skewing. The downwardly hanging outer fingers are disposed adjacent the side edges of the formed stack to hold the upper sheets therein in alignment.

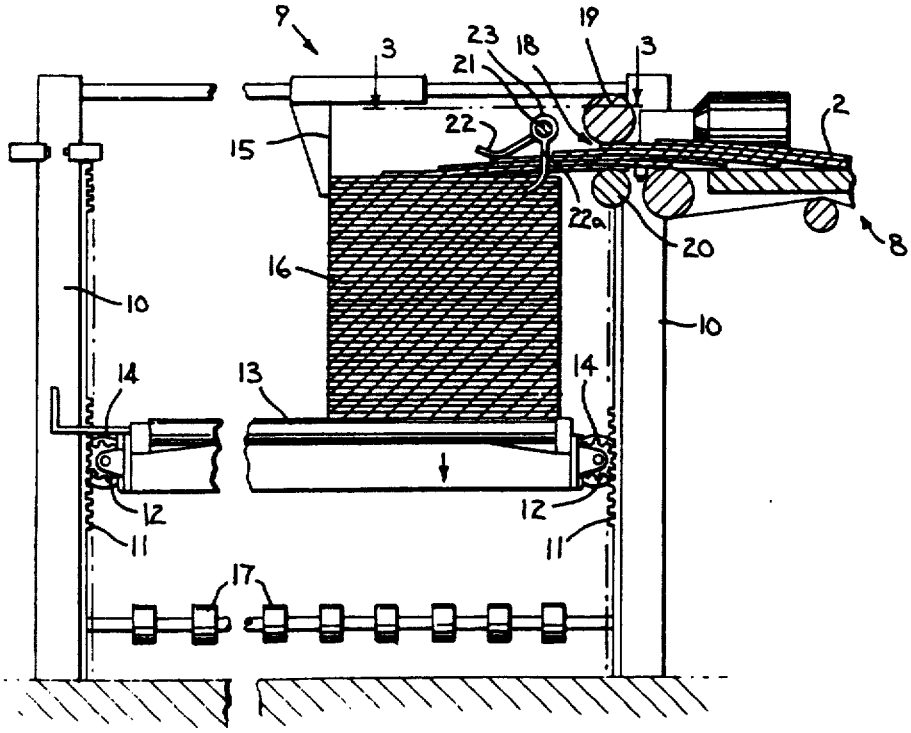

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–4 is confirmed.

* * * * *